United States Patent [19]

Carlson et al.

[11] Patent Number: 4,891,925

[45] Date of Patent: Jan. 9, 1990

[54] INTERCONNECTED CONSTRUCTION BLOCKS

[76] Inventors: Marlon Carlson, 13544 16th Avenue, Surrey, British Columbia, Canada, V4A 1P5; Julian Carlson, 13176 - 22A Avenue, White Rock, British Columbia, Canada

[21] Appl. No.: 255,211

[22] Filed: Oct. 11, 1988

[51] Int. Cl.[4] ..... E04C 1/30

[52] U.S. Cl. ..... 52/585; 52/586; 52/306

[58] Field of Search ..... 52/585, 586, 306

[56] References Cited

U.S. PATENT DOCUMENTS 1,535,514 4/1925 Warner ..... 52/586

1,809,508 6/1931 Colby ..... 52/585 X 1,985,992 1/1935 Hayman ..... 52/586 X 4,793,104 12/1988 Hultberg et al. ..... 52/306 X

*Primary Examiner*—David A. Scherbel

*Assistant Examiner*—Creighton Smith

*Attorney, Agent, or Firm*—Townsend and Townsend

[57] ABSTRACT

A construction block comprising a generally rectangular hollow body having a pair of faces joined by side edges. There are spacing flanges extending about the side edges around the perimeter of the block adjacent and essentially parallel to the faces to ensure correct spacing of the blocks when arranged in a wall construction. Cavities for connecting adjacent blocks together are provided at each corner of the block. There is a spanning member having ends adapted for engagement in the cavities of adjacent blocks in order to connect blocks into a unified wall structure.

7 Claims, 1 Drawing Sheet

Fig. 1.
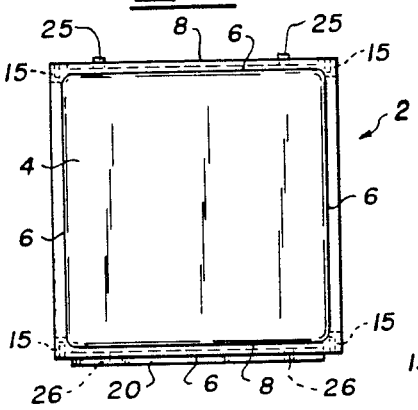
Fig. 2.
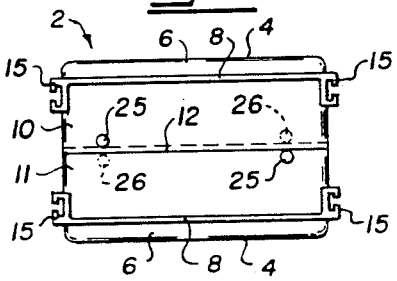
Fig. 3.
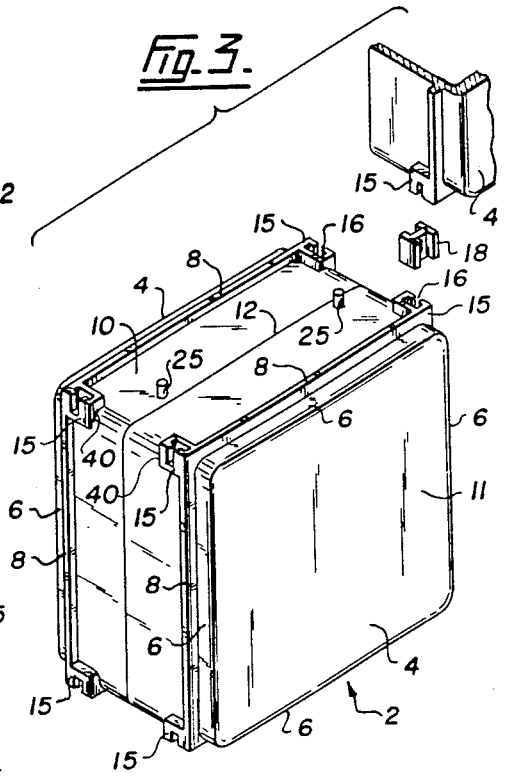
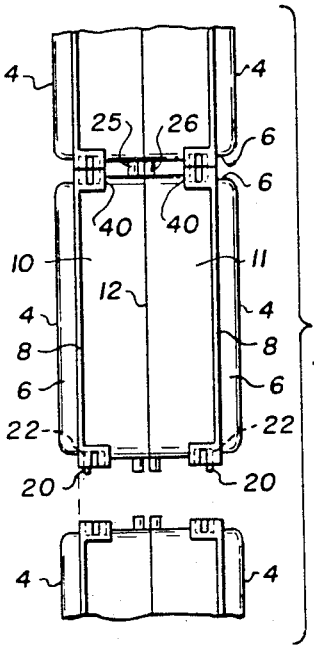
Fig. 4.
Fig. 5.
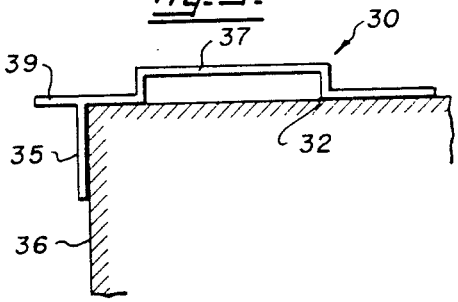

INTERCONNECTED CONSTRUCTION BLOCKS

FIELD OF THE INVENTION

This invention relates to interconnected construction blocks, and is particularly concerned with, but is not limited to hollow, plastic translucent blocks suitable for decorative wall construction.

BACKGROUND OF THE INVENTION

There is always a need for inexpensive, easily constructed and aesthetically appealing modular wall structures in the building industry. The prior art contains numerous examples of modular interlocking block units U.S. Pat. No. 3,834,100 to Healey and U.S. Pat. No. 3,936,987 to Calvin are two examples of prior art interlocking building blocks suitable for wall construction.

The construction block of the present invention is particularly suited for use in building semi-transparent partitions that are presently being constructed from glass blocks. Glass block walls have come into fashion as they provide an attractive and decorative interior or exterior wall partition that allows for passage of light into a room. Often these glass blocks have distorted surfaces in their hollow interior to prevent a person from looking through the partition.

The glass blocks presently in use have several disadvantages. The blocks are heavy and expensive and they are also fairly fragile and can shatter if dropped. Due to their heaviness, it is important when building a partition of glass blocks to start from a solid base. The blocks are separated by spacing and levelling pieces and mortar is inserted between the blocks to locate them in place. Finishing grout is then used to fill the spaces between the blocks to present an attractive finished appearance. Spacing and levelling is a very time consuming and labour intensive job requiring a skilled workman and only adds to the cost of a glass block partition wall.

Prior art has been developed specifically for use as substitutes for glass blocks. U.S. Pat. No. 3,798,861 to Weiss discloses an interlocking translucent plastic modular block suitable as a replacement for glass blocks. Weiss uses contoured blocks having tapered projections and cavities on their upper and lower surfaces for interlocking engagement to form stacked columns of blocks. The sides of a columns are held by a specially formed retaining strip, and a wall is formed from multiple columns of blocks positioned side by side. The retaining strip and the stacked column arrangement of Weiss does not produce a partition that has the desirable appearance of a conventional glass block wall.

SUMMARY OF THE INVENTION

The present invention provides a construction module that is easy and inexpensive to construct and is particularly suited for constructing a partition that is virtually identical in appearance to a conventional glass block wall. However, the construction blocks of the present invention are not as costly, heavy or fragile as conventional glass blocks. In addition, the blocks have interconnecting means for joining together adjacent blocks making spacing and aligning of the blocks a very simple task.

Accordingly, the present invention comprises:

a construction block comprising a generally rectangular hollow body having a pair of faces joined by side edges;

spacing flanges extending about said side edges around the perimeter of said block adjacent and essential)y parallel to said faces to ensure correct spacing of said blocks when arranged in a wall construction;

cavities for connecting adjacent blocks together at each corner of said block;

connecting means comprising a spanning member having ends adapted for engagement in said cavities of two adjacent blocks in order to connect said blocks into a unified wall structure.

BRIEF DESCRIPTION OF THE DRAWINGS

A preferred embodiment of the present invention is illustrated in the following figures in which:

FIG. 1 is a side view of a block built according to the present invention;

FIG. 2 is a plan view of a block built according to the present invention;

FIG. 3 shows the connecting means and the manner in which block are joined together.

FIG. 4 is an end-view showing how the blocks are connected together.

FIG. 5 is a cross-sectional view of an alignment strip for attachment to a reference wall to allow for proper alignment and positioning of a partition built from blocks of the present invention.

DESCRIPTION OF THE PREFERRED EMBODIMENTS

Referring to FIGS. 1 and 2, there is shown a construction block 2 built according to the present invention. The block has an essentially rectangular form with a pair of parallel faces 4 by joined by side edges 6. Preferably, the block is molded from suitable plastic as two identical hollow halves 10 and 11 which are permanently joined together along seam 12. The resulting block is a completely enclosed unit having a hollow interior. The block can formed from translucent plastic so that it is able to transmit light.

In the illustrated embodiment, the construction block of the present application has been molded such that it will resemble a conventional glass block when a number of blocks are combined into a wall partition. It is anticipated that the blocks of the present invention can be formed into any regular, essentially rectangular shape and can be opaque, translucent or transparent, and are not limited in shape to the preferred embodiment shown in the drawings.

The side edges 6 of the block are formed with spacing flanges 8 extending perpendicularly outward from the plane of the side edges adjacent and parallel to each face 4. These spacing flanges extend around the perimeter of each block and when the blocks are stacked together as shown in FIG. 4, the flanges bear against the corresponding spacing flanges of an adjacent block to automatically space the blocks evenly and consistently. With conventional glass blocks, ensuring correct spacing of the blocks requires that separate cross shaped spacing pieces be inserted between blocks as they are put into place which is a very time consuming process.

As best shown in FIGS. 2 and 3, at each corner of the block spacing flange 8, a enlarged portion 15 is formed with an internal cavity 16 to allow for interconnecting of adjacent construction blocks using connecting member 18. In the illustrated embodiment, portions 15 extend inwardly away from faces 4 such that the portions do not extend beyond the edges of the spacing flange when viewed from the side as shown in FIG. 1. This arrangement means that the enlarged portions do not interfere with the proper engagement of the spacing flanges.

In the illustrated embodiment, cavities 16 have a T-shaped cross-section as viewed from above. Connecting member 18 has corresponding T-shaped ends connected by a spanning member, each end being adapted for locking engagement in cavities 16 of a pair of adjacent blocks. As shown in FIG. 3, connecting member 18 is twice as high as cavity 16 is deep such that each end of a single connecting member fits into the cavities of two stacked blocks one atop the other. In addition, the opposite end of the connecting member joins another two stacked block so that each connecting member 18 is interconnecting four blocks at each corner.

While the present embodiment shows T-shaped cavities 16 and connecting members 18, it is understood that other shapes of the cavities and connecting members are possible to provide a locking fit of the blocks.

In addition, to the cavities and connecting members, the blocks of the present invention can also be formed with interlocking flanges 20 on the base of each block. Such interlocking flanges are best shown in FIGS. 1 and 4. These flanges are formed integrally with the spacing flanges on the lower side edge of each block and extend downwardly from the inner edge 22 of the spacing flange between enlarged portions 15. As shown in FIG. 4, when placed atop another block, interconnecting flanges 20 of the uppermost block overlap and interlock between the upper spacing flanges of the lowermost block to assist in positively locating the blocks atop each other in a vertical stacked column. Cavities 16 and connecting members 18 ensure that adjacent columns of blocks are connected together.

It is desirable when constructing a partition using the blocks of the present invention to include a reinforcing bar between each horizontal layer of blocks. Provision is made for positioning and aligning by including offset alignment pins 25 on the upper and lower side edges of each block straddling the center line of the block. On the opposite side edge of the block, the alignment pins are formed in a complementary pattern such that when two blocks are stacked together, the pins on the upper surface of the lower block and the pins on the lower surface of the upper block combine to form two sets of paired alignment pins that straddle a reinforcing bar 26.

The interconnecting nature of the blocks of the present invention means that constructing a wall partition is much easier than with conventional glass blocks. Alignment of the blocks, which must be continually checked and re-checked when using glass blocks, is no longer a problem as the spacing flanges and interconnecting means of the present invention automatically maintain correct alignment and trueness of a wall being built. Once the blocks have been assembled into a partition, grout can be used to cover the recessed spacing flanges between faces 4 of the blocks resulting in a translucent partition that is virtually indistinguishable from a more expensive glass block wall. Alternatively, partitions other than ones able to transmit light can be built in an identical manner using blocks of the present invention formed from an opaque plastic or other suitable material.

The construction block of the present invention can be used in combination with an alignment strip 30 having a cross-section as shown in FIG. 5. Alignment strip 30 comprises a length of molded plastic is cut to a length equal to the height of the partition to be constructed. Alignment strip 30 can be supplied in rolls so that it is simply necessary to unroll the desired length and cut off the desired length. Preferably, the strip is adapted to be attached to a reference surface on an existing wall by the provision of an adhesive backing layer 32. The alignment strip is accurately positioned on the reference surface to establish a starting point for the partition to be constructed. In this regard, the alignment strip is provided with ninety degree bend 35 which can be fitted about the corner of an existing wall 36 to assist in positioning when sticking the alignment strip to a wall. In addition, extension portion 39 is provided as a convenient reference guide for aligning other exterior finishing material such as siding or the like on the wall adjacent a wall constructed with the block of the present invention.

Alignment strip 30 has raised portion 37 which is dimensioned to interfit between the four inner walls 40 of enlarged portions 15 on the side edge of a construction block so that the block is positively located on the alignment strip 30. In this manner, blocks can be quickly and easily put into place using the alignment strip as a starting guide and eliminating the need time consuming alignment measurements for each block.

Although the present invention has been described in some detail by way of example for purposes of clarity and understanding, it will be apparent that certain changes and modifications may be practised within the scope of the appended claims.

We claim:

1. A construction block comprising a generally rectangular hollow body having a pair of faces joined by side edges;

spacing flanges extending about said side edges adjacent and essentially parallel to said faces to ensure correct spacing of said blocks when arranged in a wall construction;

cavities for connecting adjacent blocks together at each corner of said block having a T-shaped cross-section; and connecting means comprising a spanning member having correspondingly shaped T-ends adapted for engagement in said cavities of adjacent blocks in order to connect said blocks into a unified wall structure;

2. A construction block as claimed in claim 1 including alignment pins on said side edges to position reinforcement members extending between the blocks.

3. A construction block as claimed in claim 1 in which said block is formed from translucent plastic.

4. A construction block as claimed in claim 1 including interlocking flanges extending from said spacing flanges, said interlocking flanges being adapted to be interfitted between the spacing flanges of an adjacent block to provide an interlocking fit.

5. A construction block as claimed in claim 1 in combination with an alignment strip having mounting means for attachment to a reference surface and alignment means for positioning said construction blocks with respect to said reference surface.

6. A construction block as claimed in claim 5 in which said mounting means is an adhesive backing on said alignment strip.

7. A construction block as claimed in claim 5 in which said alignment means comprises a protruding portion of said alignment strip dimensioned to fit between said cavities of said construction block thereby positioning said block with respect to said reference surface.

* * * * *